US007712329B2

(12) United States Patent
Shaw

(10) Patent No.: US 7,712,329 B2
(45) Date of Patent: May 11, 2010

(54) OIL BALANCE SYSTEM AND METHOD FOR COMPRESSORS

(76) Inventor: David Shaw, 2 Ben Davis La., East Falmouth, MA (US) 02536

( * ) Notice: Subject to any disclaimer, the term of this patent is extended or adjusted under 35 U.S.C. 154(b) by 322 days.

(21) Appl. No.: 11/664,956

(22) PCT Filed: Sep. 27, 2005

(86) PCT No.: PCT/US2005/034651

§ 371 (c)(1),
(2), (4) Date: Apr. 6, 2007

(87) PCT Pub. No.: WO2006/041682

PCT Pub. Date: Apr. 20, 2006

(65) Prior Publication Data

US 2009/0007588 A1 Jan. 8, 2009

Related U.S. Application Data

(63) Continuation-in-part of application No. 10/959,254, filed on Oct. 6, 2004, now abandoned, which is a continuation of application No. 11/952,366, filed on Dec. 7, 2007.

(51) Int. Cl.
*F25B 43/02* (2006.01)

(52) U.S. Cl. ..... 62/470; 62/471; 62/468; 62/84; 62/510

(58) Field of Classification Search ..... 62/510, 62/470, 471, 468, 84
See application file for complete search history.

(56) References Cited

U.S. PATENT DOCUMENTS 2,076,332 A 4/1937 Zercher (Continued)

FOREIGN PATENT DOCUMENTS

EP 0 106 414 4/1984

(Continued)

OTHER PUBLICATIONS

International Search Report with Written Opinion, PCT/US2005/034651, Date Mailed Feb. 24, 2006.

(Continued)

*Primary Examiner*—Cheryl J Tyler
*Assistant Examiner*—Jonathan Koagel
(74) *Attorney, Agent, or Firm*—Cantor Colburn LLP

(57) ABSTRACT

A compressor system includes a first compressor, which has a first low side oil sump, in a first shell and a second compressor, which has a second low side oil sump, in a second shell. The first and second compressors are connected in series. There is an oil transfer conduit connected between the first low side sump of the first compressor and the second low side sump of the second compressor. The system also includes a normally open check valve in the oil transfer conduit. A method for effecting oil balance in a compressor system, the method includes establishing a first compressor in a first shell having a first low side oil sump and establishing a second compressor in a second shell having a second low side oil sump. The first and second compressors are connected in series. The method also includes positioning an oil transfer conduit between the first low side sump and the second low side sump and positioning a normally open check valve in the oil transfer conduit.

13 Claims, 5 Drawing Sheets

U.S. PATENT DOCUMENTS

| | | | | |
|---|---|---|---|---|
| 2,243,541 | A | 5/1941 | Swart | |
| 2,352,581 | A | 6/1944 | Winkler | |
| 2,646,212 | A | 7/1953 | Kellie | |
| 2,663,164 | A | 12/1953 | Kurtz | |
| 2,938,361 | A | 5/1960 | McNatt | |
| 3,072,318 | A | 1/1963 | Berger et al. | |
| 3,074,249 | A | 1/1963 | Henderson | |
| 3,226,949 | A | 1/1966 | Gamache | |
| 3,237,852 | A | 3/1966 | Shaw | |
| 3,241,746 | A | 3/1966 | Shaw | |
| 3,243,101 | A | 3/1966 | Shaw | |
| 3,377,816 | A | 4/1968 | Berger | |
| 3,465,953 | A | 9/1969 | Shaw | |
| 3,500,962 | A | 3/1970 | Kocher | |
| 3,543,880 | A | 12/1970 | Scott | |
| 3,719,057 | A | 3/1973 | Grant | |
| 3,775,995 | A | 12/1973 | Conley et al. | |
| 3,785,169 | A | 1/1974 | Gylland, Jr. | |
| 3,852,974 | A | 12/1974 | Brown | |
| 3,859,815 | A | 1/1975 | Kasahara | |
| 3,984,050 | A | 10/1976 | Gustafsson | |
| 4,180,236 | A | 12/1979 | Saarem et al. | |
| 4,197,719 | A | 4/1980 | Shaw | |
| 4,205,537 | A | 6/1980 | Dubberley | |
| 4,236,876 | A | 12/1980 | Fraser et al. | |
| 4,268,291 | A | 5/1981 | Cann | |
| 4,306,420 | A | 12/1981 | Cann | |
| 4,332,144 | A | 6/1982 | Shaw | |
| 4,439,121 | A | 3/1984 | Shaw | |
| 4,594,858 | A | 6/1986 | Shaw | |
| 4,748,820 | A | 6/1988 | Shaw | |
| 4,753,083 | A | 6/1988 | Sato | |
| 4,787,211 | A | 11/1988 | Shaw | |
| 4,833,893 | A | 5/1989 | Morita | |
| 4,947,655 | A | 8/1990 | Shaw | |
| 5,062,274 | A | 11/1991 | Shaw | |
| 5,094,085 | A | 3/1992 | Irino | |
| 5,094,598 | A * | 3/1992 | Amata et al. | 417/533 |
| 5,095,712 | A | 3/1992 | Narreau | |
| 5,123,254 | A | 6/1992 | Inoue et al. | |
| 5,191,776 | A | 3/1993 | Severance et al. | |
| 5,220,806 | A | 6/1993 | Jaster et al. | |
| 5,236,311 | A * | 8/1993 | Lindstrom | 417/254 |
| 5,303,561 | A | 4/1994 | Bahel et al. | |
| 5,410,889 | A | 5/1995 | Sjoholm et al. | |
| 5,626,027 | A | 5/1997 | Dormer et al. | |
| 5,657,637 | A | 8/1997 | Mertens | |
| 5,839,886 | A | 11/1998 | Shaw | |
| 5,894,739 | A | 4/1999 | Temos | |
| 5,927,088 | A | 7/1999 | Shaw | |
| 6,276,148 | B1 | 8/2001 | Shaw | |
| 6,931,871 | B2 * | 8/2005 | Shaw et al. | 62/228.5 |

FOREIGN PATENT DOCUMENTS

| | | |
|---|---|---|
| EP | 0 715 077 | 6/1996 |
| JP | 57168082 | 10/1982 |
| JP | 58217162 | 12/1983 |
| JP | 59191856 | 10/1984 |
| JP | 6-213170 | 8/1994 |
| WO | WO 97/32168 | 9/1997 |

OTHER PUBLICATIONS

Second Edition- "Application of Thermodynamics"; Author: Bernard D. Wood; 1982 by Bernard D. Wood; 1991 reissued by Waveland Presss, Inc.; pp. 218-222.

A Technical Handbook from SWEP; "Compact Brazed Heat Exchangers for Refrigerant Applications"; 1993; 1 pages plus cover and back sheets.

"Modern Refrigerating Machines"; Author; I. Cerepnalkovski; Elsevier Science Publishers; 1991; pp. 47-48.

"Refrigeration Principles and Systems- An Energy Approach"; Author: Edward G. Pits; Business News Publishing Company; 1991; pp. 243-245.

"Survey and Comparison of Interstage Cooling Systems for Two-Stage Compression"; Data Sheet, No. 20; May 1979; 3 pgs.

"Standard Refrigeration and Air Conditioning Questions & Answers-Third Edition"; Authors: S. M. Elonka and Q.W. Minich; McGraw-Hill, Inc.; 1983, 1973, 1961; pp. 28-31, 50-53.

"Thermal Environment Engineering- Second Edition"; Author: James L. Threlkeld; Prentice-Hall, Inc.; 1970, 1962; pp. 61-70.

"Theory of Mechanical Refrigeration"; Author: N. R. Sparks; McGraw-Hill Book Company, Inc.; 1938; pp. 111-127.

Shaw, David N. "Oil Balance System and Method for Compressors Connected in Series," U.S. Appl. No. 11/952,366, filed Dec. 7, 2007. Specification having 11 pages, Figures having 1 page.

* cited by examiner

OIL BALANCE SYSTEM AND METHOD FOR COMPRESSORS

CROSS REFERENCE TO RELATED APPLICATIONS

This is a U.S. national stage of application no. PCT/US2005/034651, filed on 27 Sep. 2005. This application, PCT/US2005/034651, is a continuation-in-part (CIP) of patent application Ser. No. 10/959,254 filed 6 Oct. 2004. Priority under 35 U.S.C. §120 is claimed from U.S. application Ser. No. 10/959,254, filed 6 Oct. 2004 the disclosure of which is also incorporated herein by reference.

This application is a continuation-in-part application which claims priority under 35 U.S.C. §120 to patent application Ser. No. 10/959,254 filed Oct. 6, 2004 now abandoned and which is now continuation application Ser. No. 11/952,366 filed Dec. 7, 2007, the entire contents of both of which are incorporated herein by reference and priority to both of which are claimed under 35 U.S.C. § 120.

BACKGROUND OF THE INVENTION

This invention relates to an oil balance system for compressors connected in series. More particularly, this invention relates to apparatus and a method for an oil balance system in which each compressor is contained in a separate shell, and in which each oil sump for each compressor is a low side sump, i.e., the inlet to each compressor is open to its respective shell, and the outlet from each compressor is sealed to the compressor.

My prior U.S. Pat. No. 5,839,886, the entire contents of which are incorporated herein by reference, relates to an oil balance system for primary and booster compressors connected in series for a heating/cooling or refrigeration system. The primary compressor has a low side sump, but the booster compressor has a high side sump (i.e., the inlet to the booster compressor is sealed to the compressor, and the outlet from the compressor is open to its shell. An open conduit extends between the oil sumps of the two compressors to transfer oil from the sump of the booster compressor to the sump of the primary compressor when the oil level in the booster compressor exceeds a normal operating level.

My prior U.S. Pat. Nos. 5,927,088 and 6,276,148, the entire contents of both of which are incorporated herein by reference, relate to boosted air source heat pumps especially suitable for cold weather climates. In the systems of these patents, a booster compressor and a primary compressor are connected in series.

Most compressors will entrain and pump out some oil, entrained in the refrigerant, during the normal course of operation. So, for a system of series connected compressors housed in separate casings, the pumped out oil will eventually return to the first compressor in the system, thus tending to raise the oil level in the sump of that compressor. As that oil level rises, this will likely cause the first compressor to pump oil to the inlet to the second compressor, so some oil will be delivered from that first compressor to the second compressor in the system, thus tending to prevent a dangerous loss of lubricant in the second compressor. Various compressor designs react differently in regard to this characteristic of pumping out oil entrained in the refrigerant, and it is known to make modifications to specific designs to enhance the tendency to pump out more oil as the level of oil rises.

However, during the course of operation of a series connected compressor system, such as the heat pump systems of my U.S. Pat. Nos. 5,927,088 and 6,276,148, refrigerant/oil imbalances can occur due to such things as, e.g., defrosting requirements, extreme load changes, etc. These imbalances may lead to unbalancing the oil levels in the two compressors; and this may result in taxing the normal oil balancing tendencies beyond their normal capabilities. Accordingly, it may be desirable to incorporate a specific oil balance system in the series connected compressor system.

SUMMARY OF THE INVENTION

In accordance with the present invention an oil balancing system is incorporated in a series connected compressor system, such as the heat pump system of my U.S. Pat. Nos. 5,927,088 and 6,276,148, wherein each compressor is housed in a hermetic casing and has a low side oil sump. An oil transfer conduit extends from the sump of the first compressor in the system (usually the booster compressor) to the sump of the second compressor (usually the primary compressor). When the first compressor is not operating and the second compressor is operating, the pressure within the casing of the first compressor is slightly higher than the pressure within the casing of the second compressor, so oil will, as desired, flow from the sump of the first compressor to the sump of the second compressor when the oil level in the first sump exceeds the height of the oil transfer conduit. However, when both compressors are operating, the pressure in the shell of the second compressor will be much higher than the pressure in the shell of the first compressor, which could cause undesirable oil and/or flow from the sump of the second compressor to the sump of the first compressor. Accordingly, and most importantly, the oil transfer conduit has a check valve which permits oil flow from the first compressor sump to the second compressor sump, but which prevents oil and/or gas flow from the second compressor sump to the first compressor sump.

BRIEF DESCRIPTION OF THE DRAWINGS

Referring now to the drawings, wherein like elements are numbered alike in the several figures.

DESCRIPTION OF THE PREFERRED EMBODIMENT

The present invention will be described in the context of a boosted sir source heat pump as disclosed in my prior U.S. Pat. Nos. 5,927,088 and 6,276,148. However, it will be understood that the present invention is applicable to any system of compressors in series where the compressors each have low side oil sumps.

Figure 1:
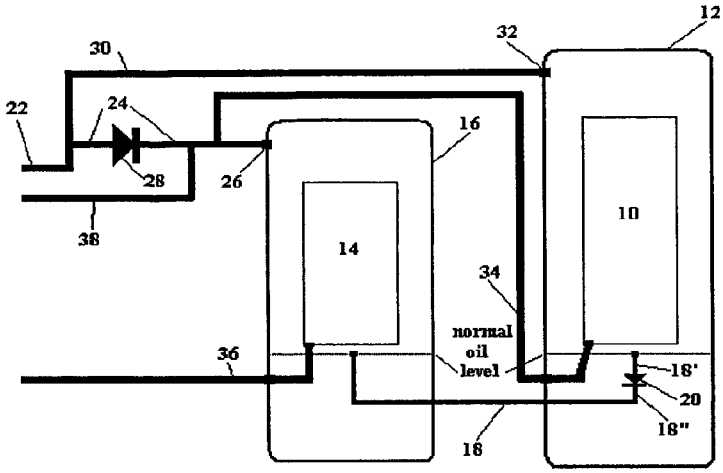
FIG. 1 is a schematic of an oil balance system of the present invention.

Referring to FIG. 1, a booster compressor 10 is housed in a hermetically sealed casing 12, and a primary compressor 14 is housed in a hermetically sealed casing 16. The compressors are preferably reciprocating compressors, but rotary or other types of compressors may be used. Each compressor is a low side sump compressor. That is, the inlet to each compressor is open to the shell of the compressor, and the outlet from each compressor is sealed to the compressor. Each compressor/casing has an oil sump at the bottom of the casing, the normal level of which is shown in shown in FIG. 1. The oil in these sumps is used to lubricate the compressors in ways presently known in the art.

An oil balance conduit 18 extends between the compressor shells at the lower parts thereof. Oil balance conduit 18 is positioned just slightly above the normal level of the sump oil in booster casing 12. A normally open check valve 20 is positioned in oil balance conduit 16. Check valve 20 permits oil flow from the sump of booster casing 12 to the sump of primary casing 16 when primary compressor 14 is on and booster compressor 10 is off or when both compressors are off, but prevents oil flow from the sump of primary casing 16 to the sump of booster casing 12 whenever both compressors are on.

A conduit 22 is connected to the low side of a system (e.g., an evaporator in a heating or cooling system), to receive refrigerant from the system low side. A branch conduit 24 is connected to the inlet 26 to primary compressor casing 16 to deliver refrigerant to the interior volume of casing 16 and to primary compressor 14. A check valve 28 in conduit 24 controls the direction of flow in conduit 24. Check valve 28 is preferably normally open to minimize the pressure drop of the fluid flowing through check valve 28 to primary inlet 26. Another branch conduit 30 connects conduit 22 to the inlet 32 to booster compressor casing 12 to deliver refrigerant to the interior volume of casing 12 and to booster compressor 10.

One end of a booster compressor discharge line 34 is sealed to booster compressor 10, and the other end of discharge line 34 is connected to branch conduit 24 downstream of check valve 28, whereby discharge line 34 delivers the discharge from booster compressor 10 to primary inlet 26 and to the interior volume of primary casing 16 and to primary compressor 14.

One end of a primary compressor discharge line 36 is sealed to primary compressor 14 and the other end of discharge line 34 is connected to the high side of the system (e.g., a condenser in a heating or cooling system).

If the system includes an economizer, a conduit 38 would be connected to conduit 24 downstream of check valve 28.

Figure 2:
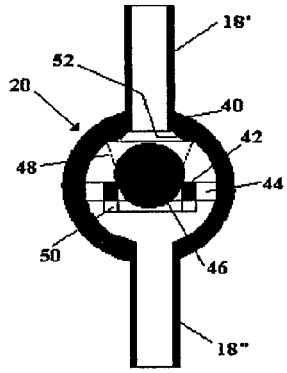
FIG. 2 is a sectional view of the oil balance check valve of FIG. 1.

Normally open check valve 20 may be maintained normally open in any chosen manner. Examples may be understood by reference to FIG. 2 where valve 20 has a spherical chamber 40 in the segments 18' and 18" of oil balance line 18. Chamber 40 is divided into upper and lower segments by a wall 42 which has peripheral flow passages 44. A ball 46 is loaded against wall 42 either by the force of gravity, or by a light spring 48 or by magnets 50. Regardless of the mechanism chosen, valve 20 is normally open to permit flow in line 18 from booster casing 10 to primary casing 16 when the pressure in the interior volume of primary casing 16 is essentially equal to or lower than the pressure in the interior volume of booster casing 12. However, if the pressure in the interior of primary casing 16 is substantially higher than the pressure in the interior volume of booster casing 12, ball 46 will be moved to engage a conical or spherical seat 52 to close the entrance from line 18' to the upper segment of chamber 40, thus blocking flow in oil balance line 18. In the operation of this invention, check valve 20 must be open when primary compressor 14 is on and booster compressor 10 is off, and when both the primary compressor 14 and the booster compressor 10 are off; and check valve 20 must be closed when both the primary compressor and the booster compressor are on.

Normally open check valve 28 may be held normally open in the same manner as valve 20 if it is also mounted vertically. However, if valve 28 is mounted horizontally, spring or magnetic loading will be required.

When both primary compressor 14 and booster compressor 10 are off, the gas pressure in primary shell 16 and in booster shell 12 will be equal. Accordingly, oil flow in balance line 18 will be bidirectional depending on the oil heads in the sumps of the primary and booster shells.

In the heating mode of operation, the booster compressor is off and only the primary compressor is operating at low heating load on the system. In this situation, normally open check valves 20 and 28 are open; and the pressure in booster shell 12 is slightly higher than the pressure in primary shell. Therefore, if the oil level in the sump of booster shell 12 is higher than its intended normal level, which means that the oil level in the sump of primary shell 16 is lower than normal, oil will flow via balance line 18 from the sump of booster shell 12 to the sump of primary shell 16 to restore normal oil levels in both sumps. Also, if the oil level in the sump primary shell 16 is very high, which means that the oil level in the sump of booster shell 12 is low, and the pressure drop between the sump of booster shell 12 and the sump of primary shell 16 is low enough, oil can flow via balance line 18 from the sump of primary shell 16 to the sump of booster shell 12.

At higher heating loads on the system, both the booster compressor and the primary compressor will be operating. In that situation, the pressure in the primary shell will be higher than the pressure in the booster shell, because the discharge from booster compressor 10 will be delivered via line 34 to casing 16, check valve 28 will be closed, and system low side will be connected via conduits 22 and 30 to the inlet 32 to booster shell 12. Accordingly, normally open check valve 20 will be closed, thus preventing back-flow of compressed gas (which would go from the discharge of booster compressor 10 to primary shell 16 and then back to booster shell 12 via balance line 18 if check valve 20 were open). However, the closure of check valve 20 also prevents oil balance flow via line 18, which can lead to oil imbalance in the sumps of the compressors, particularly creating a concern about low oil level in the sump of primary shell 16.

Some oil becomes entrained in the circulating refrigerant during the operation of the system. When both booster compressor 10 and primary compressor 16 are on, all oil entrained in the refrigerant is delivered to the shell 12 of booster compressor 10, where it tends to separate out and fall into the sump of booster shell 12. If the oil accumulates in the sump of booster shell 12 above the predetermined normal level, operation of the booster compressor will tend to agitate the oil to create a mist that will be entrained in the refrigerant discharged from booster compressor 10. This entrained oil will be delivered to the interior of primary shell 16, where it will tend to drop out from the gas due to differences in gas and oil velocities upon entering into the interior of primary shell 16. This separated oil will fall into the sump of primary shell 16 to replenish the level of oil in this sump.

Since this concern about low oil level in the sump of primary shell 16 occurs only when both the booster and primary compressors are operating, other steps can be taken to address the potential problem in addition to relying on the mist and precipitation action described in the preceding paragraph. One solution is to program the system to turn off the booster compressor for a short time (on the order of 2-4 minutes). As described above for the operational state where the primary compressor is on and the booster is off, this will result in opening normally open valve 20, and any oil built up above normal level in the sump of booster shell 12 will be transferred to the sump of primary shell 16 via transfer line 18.

Also, during defrost cycling and cooling operation, the booster compressor is off, and only the primary compressor is operating. Thus, normally open check valve 20 will be open, and oil balance transfer can take place from the sump of booster shell 12 to the sump of primary shell 16.

In the system of FIG. 1, any system condition that causes an increase in the oil level in primary compressor casing 16 above the normal level is resolved by shutting down both compressors for enough time to allow the oil levels in primary compressor casing 16 and booster compressor casing 12 to balance at their respective normal oil levels via oil balance line 18. Two examples of such system conditions are:

(1) If both compressors are operating, and the oil pumping rate of booster compressor 10 (pounds per minute of oil divided by pounds per minute of refrigerant) is significantly greater than the oil pumping rate of primary compressor 14, the oil level in primary compressor shell 16 will gradually increase, with no possibility of sending the excess back to booster compressor shell 12 without shutting off both compressors for a predetermined period of time.

(2) A second type of upset in oil levels will occur during a flooded start. A "flooded start" occurs when excess refrigerant is dissolved in the compressor sump oil prior to a startup of the system. This typically can occur during an extended outage of power to the compressor (for whatever reason, including, e.g., downed power lines, throwing a circuit breaker to the off position, etc.) and the compressor sump is allowed to cool down to ambient since the crankcase heater is not operating. This situation allows miscible liquid refrigerant to condense directly in the compressor sump oil, thus causing a refrigerant-rich solution to develop in the compressor sump oil, and also raises the sump oil level significantly. When power to the compressor is subsequently restored and the compressor is restarted, the pressure acting on this liquid solution will drop rapidly, causing foaming of the refrigerant-rich solution as the previously dissolved refrigerant is now rapidly attempting to distill (vaporize or boil) out of the oil. This action, in turn, would cause a drastic loss of foamy lubricant from the sump of booster compressor shell 12 directly into the sump of primary compressor shell 16, which is then discharged by primary compressor 14 throughout the refrigeration system. The system of FIG. 1 can deal with this situation and return the oil to the sump of booster compressor shell 12 only by one or more shutdowns of operation of both the primary compressor and the booster compressor to allow oil flow from the sump of primary compressor shell 16 to the sump of booster compressor shell 12.

The above-discussed concerns are eliminated by the embodiments of FIGS. 3, 4, 5 and 6. These embodiments also allow the connection point of oil balance line 18 to the primary compressor shell 16 to be at or above the normal oil level in the sump of primary compressor shell 16. It is even possible to make the connection point of line 18 at the inlet or suction point 26 to primary shell 16, thus eliminating the need to connect the oil balance line to primary compressor shell 16, per se. The embodiments of FIGS. 4, 5 and 6 also eliminate the need to mount the booster and primary compressor shells such that their normal oil levels are substantially identical.

In the embodiments of FIGS. 3, 4, 5 and 6, the conduit 22, which is connected to the system low side to receive refrigerant and lubricant from the system low side, is connected, via line 30, directly to the shell 12 of the booster compressor 10 at a point well above the normal level of oil in the sump of the booster shell. Also, in the embodiments of FIGS. 3, 4, 5 and 6, an enlarged chamber 64 is positioned at the junction of lines 22 and 30, and a branch conduit 60'/60, extends from the top of chamber 64 to conduit 24 to deliver refrigerant through line 24 and valve 28 to the interior of primary compressor casing 16. The enlarged chamber 64 and the conduit section 60' extending upward from chamber 64 act as an lubricant trap to separate the lubricant from the refrigerant gas and deliver the lubricant from line 22 to the interior of booster compressor shell 12, while the refrigerant vapor is delivered via lines 60',60, and 24 and valve 28 to the interior of primary compressor shell 16 when the primary compressor alone is operating. When both the primary and booster compressors are operating, both the refrigerant vapor and the lubricant are delivered to the interior of booster shell 12. Accordingly, whenever only the primary compressor is operating or both compressors are operating, at least a majority of the entrained lubricant will be returned directly to booster compressor shell 12. Line 30 may be pitched downward in order to further aid in oil return to booster shell 12 when only the primary compressor 14 is running.

Figure 3:
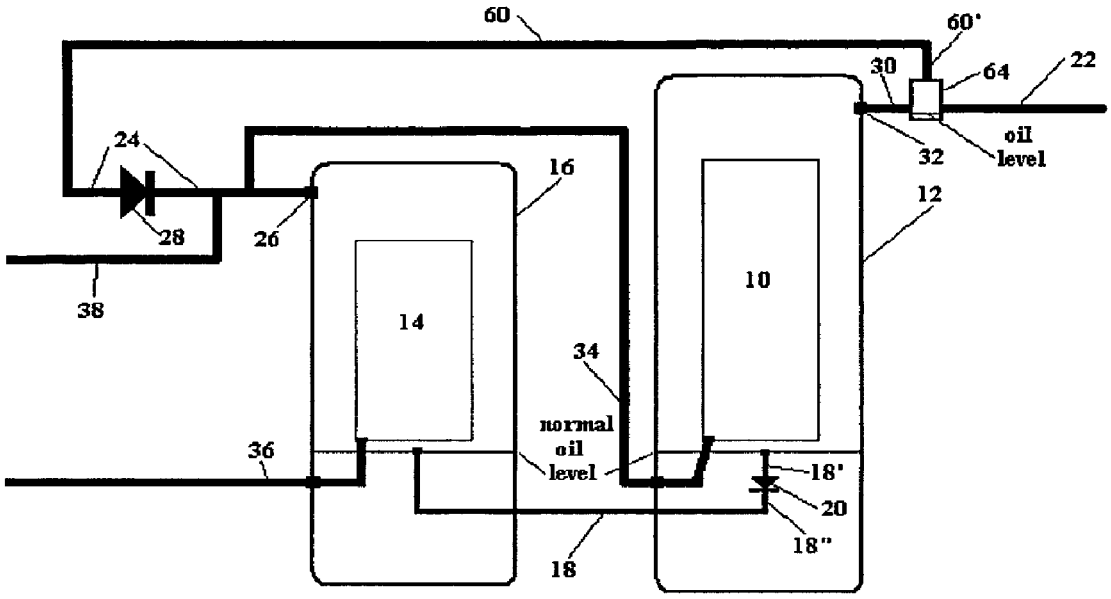
FIG. 3 is a schematic of a modified oil balance system of FIG. 1.
Figure 4:
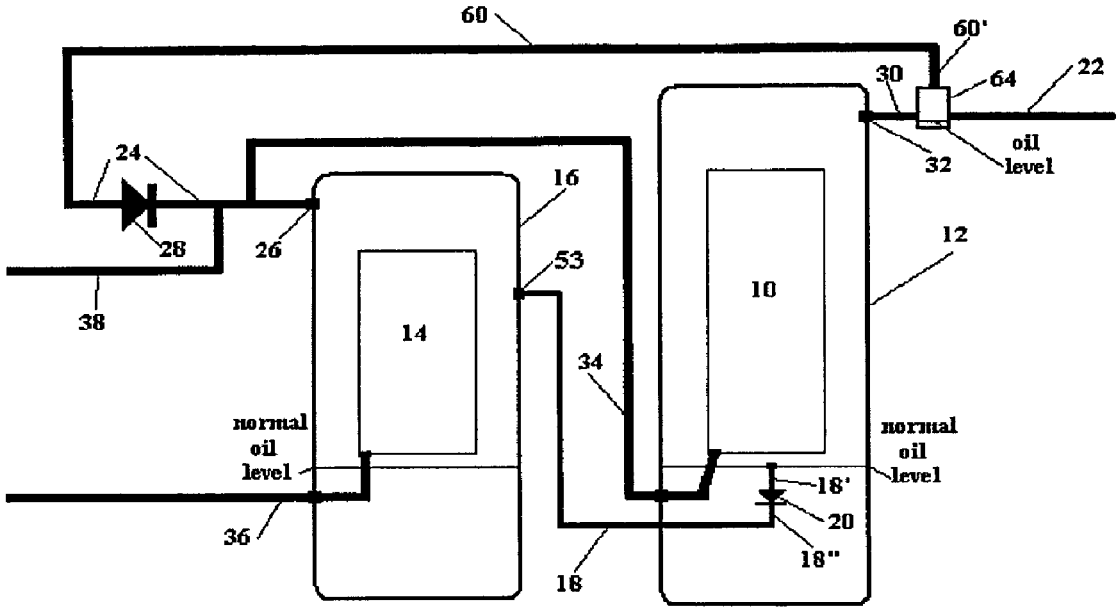
FIG. 4 is a schematic of another modified oil balance system.

In the embodiment of FIG. 3, oil balance conduit 18 is connected to shells 12 and 16 just above the normal oil levels in the sumps of the respective shells, as is the case with the embodiment of FIG. 1. However, in the embodiment of FIG. 4, while oil balance conduit 18 is also connected to shell 12 at a point just above the normal oil level in shell 12, oil balance line 18 is connected primary compressor shell 16 well above the normal oil level in shell 16. The height of the connection of oil balance line 18 to shell 16 is preferably only slightly above the normal oil level in shell 16, but it can range anywhere from just above the normal oil level in shell 16 to the top of shell 16.

Figure 5:
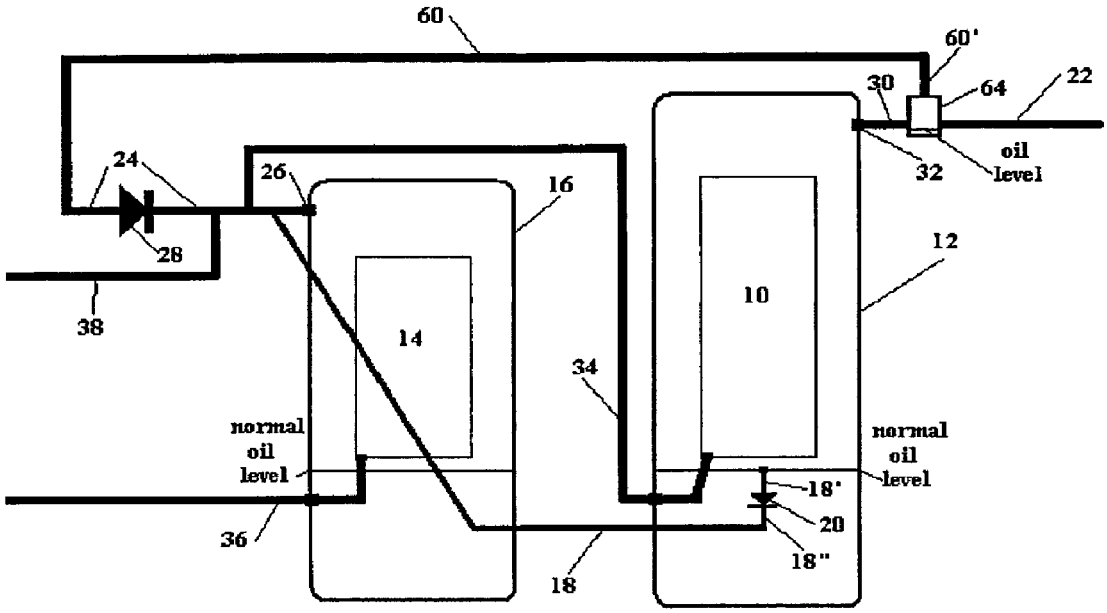
FIG. 5 is a schematic of yet another modified oil balance system.

In the embodiment of FIG. 5, one end of oil balance line 18 is again connected to booster compressor shell 12 at a point just above the normal oil level in shell 12. However, the other end of oil balance line 18 is connected to line 24 near or even at the inlet 26 to shell 16. This avoids the need to form a separate inlet to shell 16 for the end of oil balance line 18.

The system design is executed such that the total pressure drop from just downstream of point 32 on shell 12 to just downstream of point 26 on shell 16 is sufficient to cause oil flow in oil balance line 18 from the sump of the booster compressor to the sump of the primary compressor whenever only primary compressor 14 is operating (and booster compressor 10 is inoperative) whereby any excess oil in the sump of booster shell 12 is transferred to the sump of primary compressor shell 16.

With the systems of FIGS. 3, 4, 5 and 6 configured and executed as discussed above, oil levels will always be sufficiently maintained in the sumps of both the primary compressor and the booster compressor without the need for any shutdown of both compressors to achieve oil balance.

If the oil pumping rate of booster compressor 10 is higher than that of primary compressor 14, any excess oil accumulation in the sump of primary compressor 14 will be pumped into the refrigerant system and automatically delivered by line 22 and line 30 back to the sump of booster compressor 10 whenever only the primary compressor is operating. However, if both the primary compressor and the booster compressor operate together for an extended period of time, and without sufficient intervening time with only the primary compressor operating, it will be necessary to program the system for automatic shutdown of the booster compressor for a short predetermined period of time sufficient to allow excess oil accumulated in the sump of booster compressor shell 12 to be transferred via oil balance line 18 to the sump of primary compressor 16.

Figure 6:
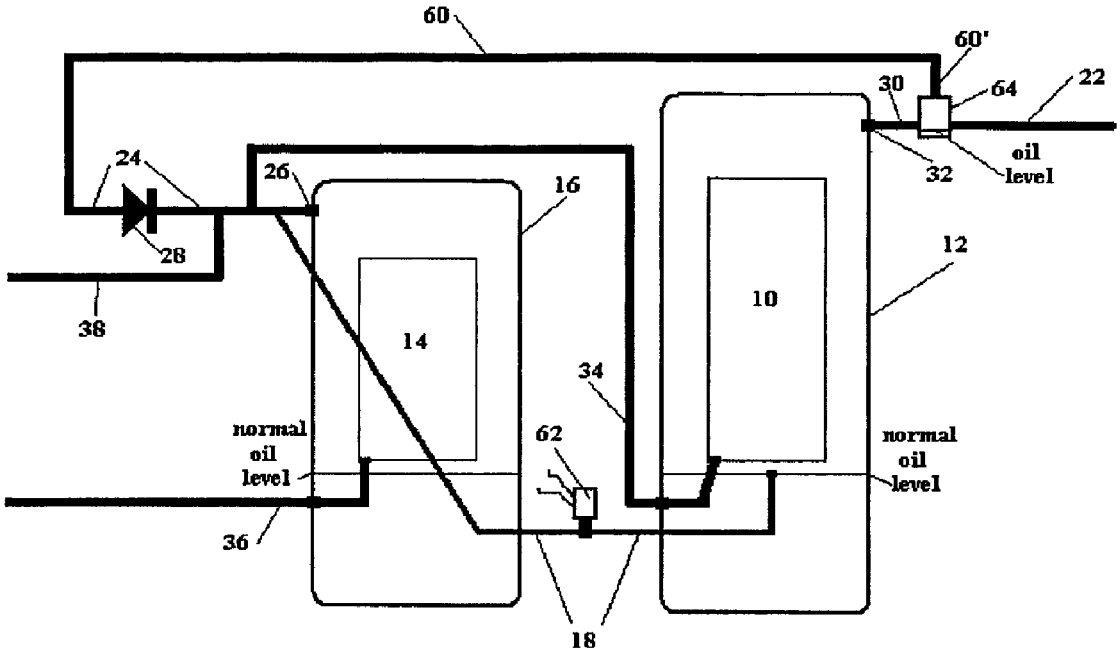
FIG. 6 is a schematic showing the use of a modified valve arrangement.

Referring now to FIG. 6, an alternative configuration is shown incorporating a solenoid valve 62 in oil balance line 18 instead of the normally open check valve 20 of the previous embodiments. While FIG. 6 shows the incorporation of solenoid valve in the system otherwise shown in FIG. 5, it will be understood that solenoid valve 62 can also be incorporated in place of the check valve 20 in the embodiments of FIGS. 1, 3, and 4. Solenoid valve 62 can be either normally open or normally closed, with the control system being programmed to open or close the solenoid valve to permit or prevent flow in oil balance line 18 in accordance with the embodiments of FIGS. 1, 3, 4 and 5. If solenoid valve 62 is used in any embodiment, there is a requirement that the valve be oriented in oil transfer line such that the higher pressure existing in primary compressor shell 16 (relative to the pressure in booster shell 12) when both compressors are operating shall act in the direction whereby the higher pressure will load the solenoid valve to the closed position to prevent flow in oil balance line 18.

While preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A compressor system for circulating refrigerant in a heating or cooling system, including:

a first compressor in a first shell, said first compressor having a first low side lubricant sump;

a second compressor in a second shell, said second compressor having a second low side lubricant sump, said first and second compressors being connected in series, and said compressors being operable with both compressors being on or with said first compressor being off and only said second compressor being on, a low side return line for refrigerant vapor, said low side return line being connected through a lubricant trap to said first shell, and a branch conduit connected from said lubricant trap to said second shell, whereby at least a majority of lubricant entrained in system refrigerant vapor is delivered directly to said first shell when only said second compressor is on or both said first and second compressors are on;

a lubricant transfer conduit connected between said first low side sump of said first compressor and said second low side sump of said second compressor; and a normally open control valve in said lubricant transfer conduit, said normally open control valve being open to permit lubricant flow in said lubricant transfer conduit from said first low side sump of said first compressor to said second low side sump of said second compressor at least when said first compressor is off and said second compressor is on, and said normally open control valve being closed to prevent flow in said lubricant transfer conduit when both said first and second compressors are on.

2. A compressor system as in claim 1, wherein said lubricant transfer conduit is connected to said first shell of said first compressor at a point just above the normal level of lubricant in said first low side sump; and said lubricant transfer conduit is connected to said second shell of said second compressor at a point just above the normal level of lubricant in said second low side sump.

3. A compressor system as in claim 1, wherein said lubricant transfer conduit is connected to said first shell of said first compressor at a point just above the normal level of lubricant in said first low side sump; and said lubricant transfer conduit is connected to said second shell of said second compressor at a point ranging from just above the normal level of lubricant in said second low side sump to the top of said second shell.

4. A compressor system as in claim 1, wherein said lubricant transfer conduit is connected to said first shell of said first compressor at a point just above the normal level of lubricant in said first low side sump; and said lubricant transfer conduit is connected at or adjacent to a refrigerant inlet to said second shell of said second compressor.

5. A compressor system as in claim 1, wherein said compressor system is a heat pump system, said first compressor being a booster compressor and said second compressor being a primary compressor.

6. A compressor system as in claim 1, wherein, said first shell has a first inlet connected to receive gas and entrained lubricant from a low side of the system, and said second shell has a second inlet connected to receive gas from a low side of the system, said first compressor has a discharge line connected at one end to said first compressor and connected at the other end to said second inlet of said second shell; and said second compressor has a discharge line connected at one end to said second compressor and at the other end to the high side of the system.

7. A compressor system as in claim 1, wherein said control valve is a normally open check valve.

8. A compressor system as in claim 1, wherein said control valve is a solenoid valve.

9. A method for effecting lubricant balance in a compressor system wherein refrigerant is circulated in a heating or cooling system, including the steps of:

establishing a first compressor in a first shell having a first low side lubricant sump;

establishing a second compressor in a second shell having a second low side lubricant sump;

said first and second compressors being connected in series, and said compressors being operable with both compressors being on or with said first compressor being off and said second compressor being on;

connecting the low side of the system through a lubricant trap to said first shell, and providing a branch connection from said lubricant trap to said second shell whereby at least a majority of lubricant entrained in system refrigerant vapor is delivered directly to said first shell when only said second compressor is on or when both said first and second compressors are on;

positioning a lubricant transfer conduit to enable lubricant flow from said first low side sump to said second low side sump; and positioning a normally open control valve in said lubricant transfer conduit to permit lubricant flow in said lubricant transfer conduit from said first low side sump to said second low side sump at least when said first compressor is off and said second compressor is on, and said normally open control valve being closed to prevent flow in said lubricant transfer conduit when both said first and second compressors are on.

10. The method as in claim 9, including the steps of connecting said lubricant transfer conduit to said first shell at a point just above the normal level of lubricant in said first shell, and connecting said lubricant transfer conduit to said second shell at a point just above the normal level of lubricant in said second shell.

11. The method as in claim 9, including the steps of connecting said lubricant transfer conduit to said first shell at a point just above the normal level of lubricant in said first shell; and connecting said lubricant transfer conduit to said second shell at a point ranging from just above the normal level of lubricant in said second shell to the top of said second shell.

12. The method of claim 9, including the steps of connecting said lubricant transfer conduit to said first shell at a point just above the normal level of lubricant in said first shell; and connecting said lubricant transfer conduit to said second shell at or adjacent to a refrigerant inlet to said second shell.

13. A compressor system as in any of claims 2, 3, and 4, wherein said control valve is a solenoid.

* * * * *